US010378706B1

(12) United States Patent
Chen et al.

(10) Patent No.: US 10,378,706 B1
(45) Date of Patent: Aug. 13, 2019

(54) TABLE LAMP CAPABLE OF CORRECTING READING HABITS

(71) Applicant: QISDA CORPORATION, Taoyuan (TW)

(72) Inventors: Zih-Ling Chen, Taipei (TW); Chih-Lung Huang, New Taipei (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/114,233

(22) Filed: Aug. 28, 2018

(30) Foreign Application Priority Data

Aug. 23, 2018 (CN) ..... 2018 1 0965243

(51) Int. Cl.

| | |
|---|---|
| ***F21S 6/00*** | (2006.01) |
| ***F21V 21/34*** | (2006.01) |
| ***F21V 23/04*** | (2006.01) |
| ***F21V 23/00*** | (2015.01) |
| *F21Y 115/10* | (2016.01) |

(52) U.S. Cl.
CPC ..... *F21S 6/003* (2013.01); *F21V 21/34* (2013.01); *F21V 23/003* (2013.01); *F21V 23/0464* (2013.01); *F21V 23/0471* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 9,719,641 | B1 * | 8/2017 | Volek | F21S 6/006 |
| 2006/0044800 | A1 * | 3/2006 | Reime | H05B 33/0803 362/276 |
| 2013/0278150 | A1 * | 10/2013 | Lou | H05B 37/0227 315/155 |
| 2016/0316543 | A1 * | 10/2016 | Liu | F21V 21/26 |
| 2017/0332460 | A1 * | 11/2017 | Sato | G06T 7/74 |

FOREIGN PATENT DOCUMENTS

CN 205480435 U * 8/2016

* cited by examiner

*Primary Examiner* — Jany Richardson

(57) ABSTRACT

A table lamp includes an infrared light sensor, a distance detection unit, a light source, and a control unit. The infrared light sensor detects infrared light. The distance detection unit detects a distance between an external object and the distance detection unit. The light source emits light. The control unit controls the light source at least according to intensity of the infrared light detected by the infrared light sensor and the distance detected by the distance detection unit.

19 Claims, 3 Drawing Sheets

TABLE LAMP CAPABLE OF CORRECTING READING HABITS

BACKGROUND OF THE INVENTION

1. Field of the Invention

The present invention is related to a table lamp, and more particularly, to a table lamp capable of correcting reading habits.

2. Description of the Prior Art

In the past, people usually receive information from books and newspaper. However, as the internet technology grows rapidly, people can access all kinds of information through diverse media with different devices, such as a smart phone, tablet, notebook, and television, increasing the burden of eyes and weakening the vision.

According to researches, poor reading habits, such as incorrect reading postures and reading in low light conditions, often result in impaired vision. Since children's vision is not yet fully developed, they are particularly vulnerable. Therefore, to create suitable reading conditions will help to protect children's vision.

SUMMARY OF THE INVENTION

One embodiment of the present invention discloses a table lamp. The table lamp includes a light source, an infrared light sensor, a distance detection unit, and a control unit.

The infrared light sensor detects infrared light. The distance detection unit detects a distance between an external object and the distance detection unit when the infrared light is beyond a predetermined intensity range. The light source emits light. The control unit controls the light source at least according to intensity of the infrared light detected by the infrared light sensor and the distance.

Another embodiment of the present invention discloses a method for operating a table lamp. The table lamp includes an infrared light sensor, a first distance detection unit, a second distance detection unit, and a light source.

The method includes the first distance detection unit detecting a first distance between an external object and the first distance detection unit when the infrared light is beyond a predetermined intensity range, the second distance detection unit detecting a second distance between the external object and the second distance detection unit when the infrared light is beyond the predetermined intensity range, and issuing a warning signal according to comparison results of comparing the first distance with a first standard value and comparing the second distance with a second standard value.

The first distance detection unit and the second distance detection unit are disposed on the table lamp at the same height, and a distance between the first distance detection unit and the second distance detection unit is substantially equal to a regular width of a human head or shoulder.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
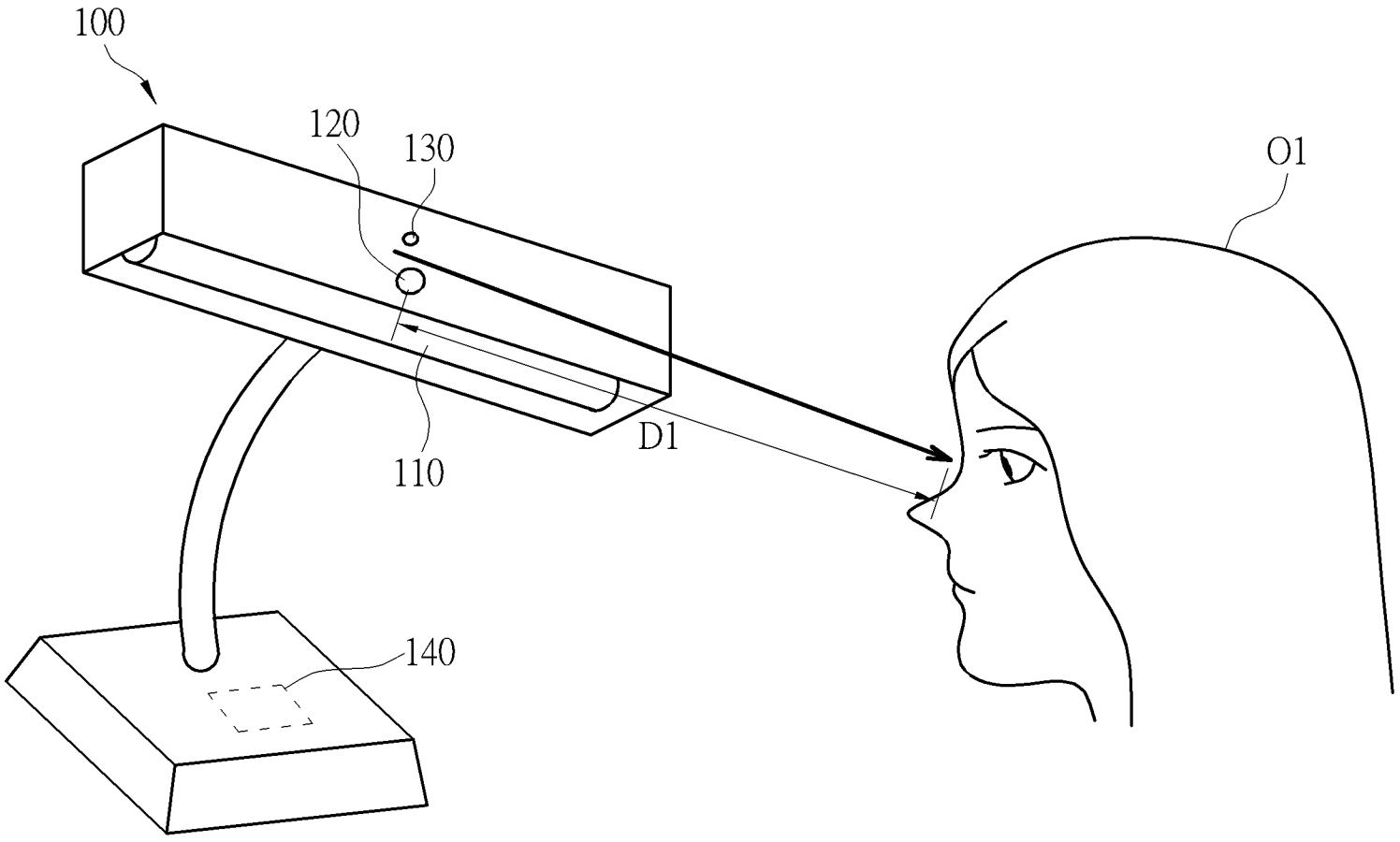
FIG. 1 shows a table lamp according to one embodiment of the present invention.

FIG. 1 shows a table lamp 100 according to one embodiment of the present invention. The table lamp 100 includes a light source 110, a first distance detection unit 120, an infrared light sensor 130, and a control unit 140.

The light source 110 can emit light to provide a more suitable reading condition. In some embodiments, the light source 110 can include light emitting diodes or fluorescent tubes.

The first distance detection unit 120 can detect the distances of external objects. For example, in FIG. 1, the first distance detection unit 120 can detect the distance D1 between an external object O1 and the first distance detection unit 120. In some embodiments, the first distance detection unit 120 can be an ultrasound distance detection unit, and can detect the distance with ultrasonic waves.

The infrared light sensor 130 can detect infrared light in the environment. Since the human body usually has a higher temperature than the environment and can emit infrared light, the control unit 140 can determine if the object is a human or not according to the intensity of infrared light detected by the infrared light sensor 130. For example, when a person draws near to the table lamp 100, the environmental temperature may be raised, and the infrared light may become beyond a predetermined intensity range. Therefore, according to the intensity of the infrared light detected by the infrared light sensor 130, the presence of people can be detected.

In some embodiments, the infrared light sensor 130 can be designed to have better sensitivity to the infrared light with wavelengths near to the infrared light emitted by the human body, so that the control unit 140 can make a more accurate judgment.

In some embodiments, the first distance detection unit 120 can detect the distances when the infrared light is beyond the predetermined intensity range, that is, the first distance detection unit 120 can detect the distances when the user appears.

For example, in FIG. 1, the external object O1 can be a human so the distance D1 can be deemed as the distance between the human and the table lamp 120. Therefore, the control unit 140 can control the light source 110 according to the distance D1, and turn on the light when the user draws near.

With the first distance detection unit 120 and the infrared light sensor 130, the control unit 140 can control the light source 110 according to both the intensity of the infrared light and the distance D1.

For example, the control unit 140 can turn on the light source 110 when the intensity of the infrared light is beyond the predetermined intensity range and the distance D1 is smaller than a predetermined value. That is, the control unit 140 can turn on the light source 110 when a human is detected to draw near. Therefore, the table lamp can provide a better reading condition for the user.

Also, the control unit 140 can turn off the light source 110 when the intensity of the infrared light is within the predetermined intensity range or the distance D1 is greater than the predetermined value for a period of time. That is, if no user is detected or if the user is rather far away from the table lamp 100, then the light source 110 can be turned off to save power. In some embodiments, the control unit 140 may further wait for a period of time before turning off the light source 110, preventing the light source 110 from being turned off due to temporary absence of the user.

Figure 2:
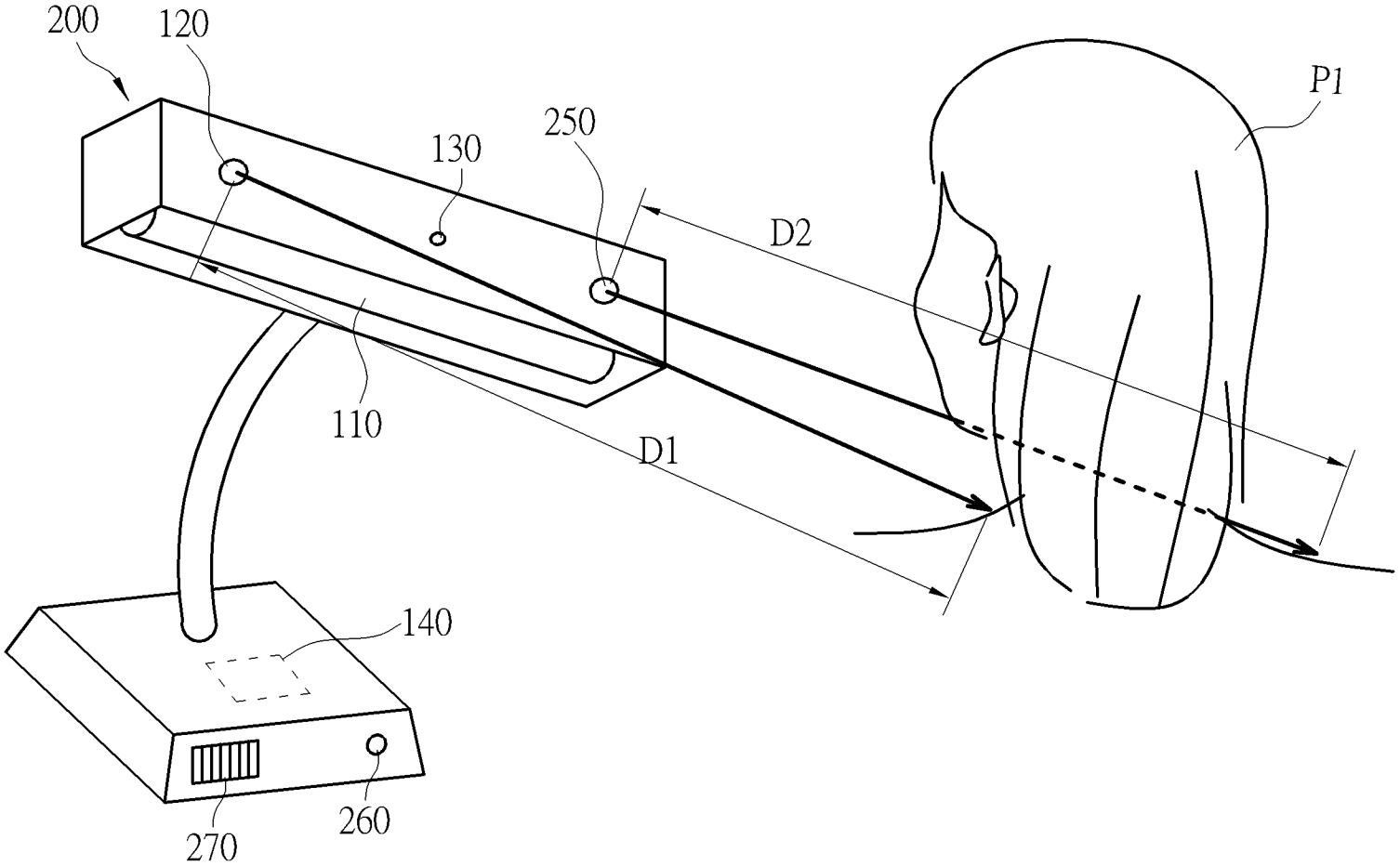
FIG. 2 shows a table lamp according to another embodiment of the present invention.

FIG. 2 shows a table lamp 200 according to another embodiment of the present invention. The table lamp 200 has a similar structure as the table lamp 100 and can be operated with similar principles. However, the table lamp 200 further includes a second distance detection unit 250. The second distance detection unit 250 can also detect the distances of external objects. For example, in FIG. 2, the second distance detection unit 250 can detect the distance D2 between the external object P1 and the second distance detection unit 250 when the infrared light is beyond the predetermined intensity range. In this case, the control unit 240 can control the light source 110 according to the intensity of the infrared light detected by the infrared light sensor 130, and the distances D1 and D2 detected by the first distance detection unit 120 and the second distance detection unit 250.

In FIG. 2, the first distance detection unit 120 and the second distance detection unit 250 are disposed on the table lamp 200 at the same height. Also, the distance between the first distance detection unit 120 and the second distance detection unit 250 can be designated to be substantially equal to a regular width of a human shoulder or head. That is, the first distance detection unit 120 and the second distance detection unit 250 can detect the distances of different parts of the external object P1. For example, the first distance detection unit 120 and the second distance detection unit 250 may detect the distance between the first distance detection unit 120 and the left shoulder of the user, and the distance between the second distance detection unit 250 and the right shoulder of the user respectively; or the distance between the first distance detection unit 120 and the left ear of the user, and the distance between the second distance detection unit 250 and the right ear of the user respectively.

In some embodiments, the first distance detection unit 120 and the second distance detection unit 250 may be used to detect other parts of the user. In this case, the first distance detection unit 120 and the second distance detection unit 250 would be disposed at proper positions correspondently. Also, according to the specific distances detected by the first distance detection unit 120 and the second distance detection unit 250, the control unit 240 can determine a first standard value and a second standard value. The two standard values can be used to indicate the correct reading posture. For example, the two standard values can be determined during a calibration process when the user is sitting in front of the table lamp 200 with a correct reading position. In some embodiments, the table lamp 200 can further include panels or buttons for control the calibration process.

Consequently, according to the comparison results of comparing the distance D1 with the first standard value and comparing the distance D2 with the second standard value, the control unit 240 can detect if the user has a bad reading posture different from the correct reading position and issue a warning signal to notify the user. Consequently, whenever the user has an inappropriate reading posture, the table lamp 200 can issue the warning signal to remind the user.

For example, if the first standard value and the second standard value are the standard distances of the user's ears to the table lamp 200 when the user sits in a correct reading position, then the control unit 240 may issue the warning signal when the distance D1 is greater than the first standard value and the distance D2 is smaller than the second standard value since the user may lean to one side and sit with an inappropriate posture in this case.

In addition, if the distance D1 is smaller than the first standard value and the distance D2 is smaller than the second standard value, then the control unit 240 can also issue the warning signal to remind the user to sit straight and keep a proper distance from the table lamp 200.

In FIG. 2, the table lamp 200 can further include a warning signal light 260 and a warning sound generator 270. The warning signal light can emit light when the control unit 240 issues the warning signal, and the warning sound generator 270 can generate a warning sound when the control unit 240 issues the warning signal. Therefore, whenever the user has an incorrect reading posture, the table lamp 200 can notify the user with light and sound. However, in some embodiments, the table lamp 200 can use one of the warning signal light 260 and the warning sound generator 270 and omit the other according to the system requirement.

Consequently, the table lamp 200 can help to provide a reading environment with sufficient lighting when the user draws near and reads. Also, the table lamp 200 can remind the user to sit appropriately to correct her/his reading habits, protecting the vision of user.

Furthermore, in the embodiment shown in FIG. 2, the table lamp 200 can control the light source 110 with the infrared light sensor 130 and the distance detection units 120 and 250. However, in some other embodiments, according to the system requirement, the table lamp 200 can also control the light source 110 with the distances detected by the distance detection units 120 and 250 without the infrared light sensor 130, and the infrared light sensor 130 can be omitted.

Figure 3:
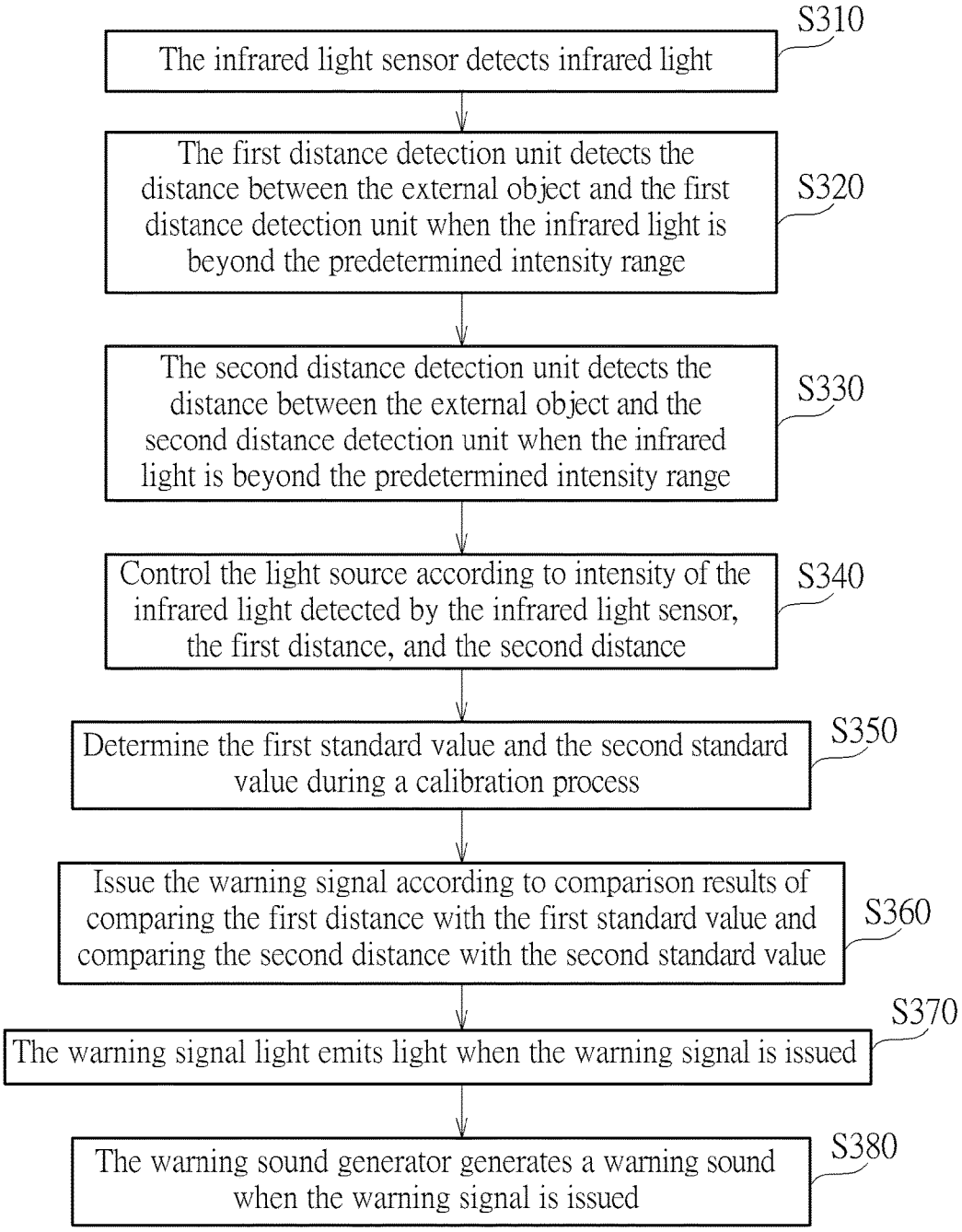
FIG. 3 shows a method for operating the table lamp in FIG. 2 according to one embodiment of the present invention.

FIG. 3 shows a method 300 for operating the table lamp 200. The method 300 includes steps S310 to S380, but not limited to the order shown in FIG. 3.

S310: the infrared light sensor 130 detects infrared light;

S320: the first distance detection unit 120 detects the distance D1 between the external object P1 and the first distance detection unit 120 when the infrared light is beyond the predetermined intensity range;

S330: the second distance detection unit 250 detects the distance D2 between the external object P1 and the second distance detection unit 250 when the infrared light is beyond the predetermined intensity range;

S340: control the light source 110 according to intensity of the infrared light detected by the infrared light sensor 130, the distances D1 and D2;

S350: determine the first standard value and the second standard value during a calibration process;

S360: issue the warning signal according to comparison results of comparing the distance D1 with the first standard value and comparing the distance D2 with the second standard value;

S370: the warning signal light 260 emits light when the warning signal is issued; and S380: the warning sound generator 270 generates a warning sound when the warning signal is issued.

In steps S310 to S330, the infrared light sensor 130 can detect the infrared light in the environment, and the distance detection units 120 and 250 can detect the distances of different parts of the external object P1 when the infrared light is beyond the predetermined intensity range. Therefore, the table lamp 200 can detect if the user has drawn near for reading and control the light source 110 accordingly in step S340.

For example, the step S340 can include turning on the light source 110 when the intensity of the infrared light is greater than a predetermined intensity and the distance D1 or D2 is smaller than a predetermined value. Also, the step S340 can include turning off the light source 110 when the intensity of the infrared light is smaller than the predetermined intensity or the distance D1 or D2 is greater than the predetermined value for a period of time.

However, in some embodiments, if the infrared light sensor 130 is omitted, step S330 is also skipped, and the table lamp 200 can control the light source 110 with the distances detected by the distance detection units 120 and 250.

In step S350, the table lamp 200 can determine the standard values during the calibration process to set up the comparing references for determining if the sitting position of the user is correct or not. Therefore, in step S360, the warning signal will be issued according to the comparison results. For example, the step S360 can include issuing the warning signal when the distance D1 is greater than the first standard value and the distance D2 is smaller than the second standard value, and issuing the warning signal when the distance D1 is smaller than the first standard value and the distance D2 is smaller than the second standard value.

Once the warning signal is issued, the warning signal light 260 and the warning sound generator 270 can generate light and sound to notify the user and remind the user of keeping the correct reading position. In some embodiments, the table lamp 200 may include one of the warning signal light 260 and the warning sound generator 270. In this case, one of the steps S370 and S380 may be skipped according to the system requirement.

In summary, the table lamp and the method for operating the table lamp provided by the embodiments of the present invention can control the light according to the presence of the user and the distance between the user and the table lamp; therefore, whenever the user draws near, the table lamp can provide a better reading environment, protecting the user's vision. Also, with the distance detection units, the incorrect reading posture can be detected, and the warning signal can be sent to notify the user to adjust his/her reading posture.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A table lamp comprising:

an infrared light sensor configured to detect infrared light;

a first distance detection unit configured to detect a first distance between an external object and the first distance detection unit when the infrared light is beyond a predetermined intensity range;

a light source configured to emit light; and a control unit configured to control the light source at least according to intensity of the infrared light detected by the infrared light sensor and the first distance;

wherein the control unit turns on the light source when the intensity of the infrared light is beyond the predetermined intensity range and the first distance is smaller than a predetermined value.

2. The table lamp of claim 1, wherein:

the control unit turns off the light source when the intensity of the infrared light is within the predetermined intensity range or the first distance is greater than a predetermined value for a period of time.

3. The table lamp of claim 1, further comprises:

a second distance detection unit configured to detect a second distance between the external object and the second distance detection unit when the infrared light is beyond the predetermined intensity range;

wherein:

the first distance detection unit and the second distance detection unit are disposed on the table lamp at a same height, and a distance between the first distance detection unit and the second distance detection unit is equal to a regular width of a human head or shoulder;

the control unit is further configured to determine a first standard value and a second standard value during a calibration process; and the control unit is further configured to issue a warning signal according to comparison results of comparing the first distance with the first standard value and comparing the second distance with the second standard value.

4. The table lamp of claim 3, wherein the control unit issues the warning signal when the first distance is greater than the first standard value and the second distance is smaller than the second standard value.

5. The table lamp of claim 1, wherein the first distance detection unit is an ultrasound distance detection unit.

6. A table lamp comprising:

a first distance detection unit configured to detect a first distance between an external object and the first distance detection unit;

a second distance detection unit configured to detect a second distance between the external object and the second distance detection unit;

a light source configured to emit light; and a control unit configured to issue a warning signal according to comparison results of comparing the first distance with a first standard value and comparing the second distance with a second standard value;

wherein the first distance detection unit and the second distance detection unit are disposed on the table lamp at a same height, and a distance between the first distance detection unit and the second distance detection unit is equal to a regular width of a human head.

7. The table lamp of claim 6, wherein the control unit is further configured to determine the first standard value and the second standard value during a calibration process.

8. The table lamp of claim 6, wherein the control unit issues the warning signal when the first distance is greater than the first standard value and the second distance is smaller than the second standard value.

9. The table lamp of claim 6, wherein the control unit issues the warning signal when the first distance is smaller than the first standard value and the second distance is smaller than the second standard value.

10. The table lamp of claim 6, further comprising at least one of:

a warning signal light configured to emit light when the control unit issues the warning signal; and a warning sound generator configured to generate a warning sound when the control unit issues the warning signal.

11. The table lamp of claim 6, wherein the first distance detection unit is an ultrasound distance detection unit.

12. A method for operating a table lamp, the table lamp comprising a first distance detection unit, a second distance detection unit, and a light source, and the method comprising:

the first distance detection unit detecting a first distance between an external object and the first distance detection unit;

the second distance detection unit detecting a second distance between the external object and the second distance detection unit; and issuing a warning signal according to comparison results of comparing the first distance with a first standard value and comparing the second distance with a second standard value;

wherein the first distance detection unit and the second distance detection unit are disposed on the table lamp at a same height, and a distance between the first distance detection unit and the second distance detection unit is equal to a regular width of a human head or shoulder.

13. The method of claim 12, further comprising:

determining the first standard value and the second standard value during a calibration process.

14. The method of claim 12, wherein issuing the warning signal according to the comparison results of comparing the first distance with the first standard value and comparing the second distance with the second standard value comprises at least one of following two steps:

issuing the warning signal when the first distance is greater than the first standard value and the second distance is smaller than the second standard value; and issuing the warning signal when the first distance is smaller than the first standard value and the second distance is smaller than the second standard value.

15. The method of claim 12, wherein the table lamp further comprises a warning signal light, and the method further comprises the warning signal light emitting light when the warning signal is issued.

16. The method of claim 12, wherein the table lamp further comprises a warning sound generator, and the method further comprises the warning sound generator generating a warning sound when the warning signal is issued.

17. The method of claim 12, wherein the table lamp further comprises an infrared light sensor, and the method further comprises:

the infrared light sensor detecting infrared light; and controlling the light source according to intensity of the infrared light detected by the infrared light sensor, the first distance, and the second distance;

wherein:

the first distance detection unit detects the first distance between the external object and the first distance detection unit when the infrared light is beyond a predetermined intensity range; and the second distance detection unit detects the second distance between the external object and the second distance detection unit when the infrared light is beyond the predetermined intensity range.

18. The method of claim 17, wherein controlling the light source according to the intensity of the infrared light detected by the infrared light sensor, the first distance, and the second distance comprises:

turning on the light source when the intensity of the infrared light is beyond the predetermined intensity range and the first distance is smaller than a predetermined value.

19. The method of claim 17, wherein controlling the light source according to the intensity of the infrared light detected by the infrared light sensor, the first distance, and the second distance comprises:

turning off the light source when the intensity of the infrared light is within the predetermined intensity range or the first distance is greater than a predetermined value for a period of time.

* * * * *